US006332405B1

(12) United States Patent
Bergemann

(10) Patent No.: US 6,332,405 B1
(45) Date of Patent: Dec. 25, 2001

(54) SWITCHGEAR FOR A SUSPENDED CONVEYOR DEVICE

(75) Inventor: Horst Bergemann, Landsberg (DE)

(73) Assignee: WF Logistik GmbH, Landsberg (DE)

( * ) Notice: Subject to any disclaimer, the term of this patent is extended or adjusted under 35 U.S.C. 154(b) by 0 days.

(21) Appl. No.: 09/582,208

(22) PCT Filed: Jan. 20, 1999

(86) PCT No.: PCT/EP99/00369

§ 371 Date: Jul. 18, 2000

§ 102(e) Date: Jul. 18, 2000

(87) PCT Pub. No.: WO99/36628

PCT Pub. Date: Jul. 22, 1999

(30) Foreign Application Priority Data

Jan. 20, 1998 (DE) ..... 298 00 910 U

(51) Int. Cl.[7] ..... E01B 7/00

(52) U.S. Cl. ..... 104/130.01; 104/130.1; 104/130.07; 104/89; 246/434

(58) Field of Search ..... 104/130.01, 130.04, 104/130.06, 130.07, 130.11, 89, 96, 93, 100, 172.4; 246/434

(56) References Cited

U.S. PATENT DOCUMENTS

| | | | | |
|---|---|---|---|---|
| 1,701,310 | * | 2/1929 | Saborsky | 104/13 |
| 3,541,965 | | 11/1970 | MCElroy | 104/130 |
| 3,999,730 | | 12/1976 | Gonsales et al. . | |
| 5,199,574 | | 4/1993 | Hollyfied, Jr. et al. . | |
| 5,199,674 | * | 4/1993 | Mihirogi | 246/434 |

FOREIGN PATENT DOCUMENTS

| | | | |
|---|---|---|---|
| 632088 | | 8/1935 | (DE) . |
| 1 070 103 | | 11/1959 | (DE) . |
| 19 16 359 | | 5/1965 | (DE) . |
| 88 07 284 | | 11/1989 | (DE) . |
| 38 19 009 | | 12/1989 | (DE) . |
| 0 476 170 | | 3/1992 | (EP) . |
| 0529443 A1 | * | 8/1992 | (EP) . |
| 1196359 | * | 2/1965 | (SE) . |

* cited by examiner

*Primary Examiner*—S. Joseph Morano
*Assistant Examiner*—Frantz F. Jules
(74) *Attorney, Agent, or Firm*—Arent Fox Kinter Plotkin & Kahn, PLLC

(57) ABSTRACT

A diverter for a suspended conveying apparatus in which conveyable-article carriers provided with running rollers are guided on running rails. A diverter tongue is connected to a running-rail section via an articulated arrangement so as to be pivotable between two diverter positions. The articulated arrangement includes a bridging element that connects the running profile of the running-rail section to the running profile of the diverter tongue and is mounted to be pivoted about an axis on the running-rail section as well as about an axis on the diverter tongue. In a transition region between the running-rail section and the bridging element, in each case one running-roller guide surface of the running-roller section and one running-roller guide surface of the bridging element run one beside the other in the conveying direction to respectively support a running roller of a conveyable-article carrier. In a transition region between the bridging element and the diverter tongue, a running roller guide surface of the bridging element and a running-roller guide surface of the diverter tongue run one beside the other in a conveying direction to respectively support a running roller.

9 Claims, 1 Drawing Sheet

SWITCHGEAR FOR A SUSPENDED CONVEYOR DEVICE

The invention relates to a diverter for a conveying apparatus, in particular a suspended conveying apparatus, in which conveyable-article carriers provided with running rollers are guided such that they can be moved on running profiles of running rails, wherein the diverter has a diverter tongue which is designed as a movable running rail and, at one end, is connected to a connection end of a first running-rail section via an articulated arrangement so as to be pivotable between two diverter positions such that the diverter-tongue end remote from the articulated arrangement can be connected optionally to a free end of a second running-rail section or to a free end of a third running-rail section, wherein the articulated arrangement has a running-profile bridging element which connects the running profile of the first running-rail section, at the connection end thereof, to the running profile of the diverter tongue, at the end thereof which is adjacent to the first running-rail section, the bridging element being mounted such that it can be pivoted about a first pivot axis at the connection end of the first running-rail section and such that it can be pivoted about a second pivot axis, which is essentially parallel to the first pivot axis, at the adjacent end of the diverter tongue.

DE 38 19 009 A1 discloses a diverter for a suspended conveying arrangement in which the running rails have an approximately roof-like profile with oblique running surfaces for the running rollers of conveyable-article carriers which can be moved along the running rails. The conveyable-article carriers are so-called V-trolleys which are supported on the running surfaces of the running rails in a suspended manner by way of running-roller pairs, the running rollers of a running-roller pair being connected to one another in each case by an approximately V-shaped bracket which encloses the relevant running rail on its underside and has means for fastening conveyable articles, for example items of clothing hanging on clothes hangers, on its underside.

In the diverter according to DE 38 19 009 A1, the diverter tongue is connected directly to the connection end of the first running-rail section via a pivot pin. The diverter tongue may be pivoted optionally into three different diverter positions in order to connect the first running-rail section to a second, a third or a fourth running-rail section for the continued advancement of conveyable-article carriers. In a first diverter position, the diverter tongue is aligned essentially rectilinearly with the first running-rail section. In the other two diverter positions, however, the diverter tongue is pivoted relative to the first running-rail section, with the result that there is an inflexion, and thus discontinuity, of the running path at the transition location from the first running-rail section to the diverter tongue. The more pronounced this inflection is, the less steadily do the conveyable-article carriers run as they pass the transition location between the first running-rail section and the diverter tongue. In particular in the case of conveyable-article carriers which are subjected to relatively pronounced loading, the running rollers undergo jerky deflection in the transition region between the first running-rail section and diverter tongue, with the result that there may be impact loading between the running rollers and the elements of the diverter. Irrespective of the running noise produced by the conveyable-article carriers in this case, the running rollers and the bearings thereof as well as the elements of the diverter are subjected to increased wear on account of said impact loading. For the abovementioned reasons, this type of diverter which is well-regarded on account of its straightforward construction, has been used up until now predominantly in conveying apparatuses in which the conveyable-article carriers only have to transport relatively small loads.

A diverter of the type mentioned in the introduction is known from German Utility Model 19 16 359. This known diverter already has a running-profile bridging element or intermediate element, between the first running-rail section and the diverter tongue which is mounted such that it can be pivoted about a first pivot axis at the connection end of the first running-rail section and such that it can be pivoted about a second pivot axis, which is essentially parallel to the first pivot axis, at the adjacent end of the diverter tongue.

The running-profile bridging element bridges a distance between the mutually adjacent running-profile ends of the first running-rail section and the diverter tongue. If the diverter tongue is pivoted into a position which is angled in relation to the first running-rail section, with the result that it forms an angle of inflection with the first running-rail section, then it is also possible for the running-profile bridging element to be moved into an angled position relative to the first running-rail section, but also relative to the diverter tongue, although the angles which the running-profile bridging element forms with the first running-rail section and with the diverter tongue are each smaller than the angle of inflection between the first running-rail section and the diverter tongue. This results in the running rollers of conveyable-article carriers, in the transition region from the first running-rail section to the diverter tongue, undergoing two relatively gentle deflections, namely when they roll from the running surfaces of the first running-rail section onto the running surfaces of the running-profile bridging element, which is provided with a corresponding running profile, and when they pass from the running surfaces of the running-profile bridging element onto the running surfaces of the diverter tongue. Corresponding conditions apply when a conveyable-article carrier passes the transition location from the direction of the diverter tongue.

In the diverter according to German Utility Model 19 16 359, the running-profile bridging element or intermediate element causes separating locations of shallow curvature which act in each case as continuous interruptions or as transverse gaps in the path for the running rollers of the relevant conveyable-article carriers. These transverse-gap-like interruptions in the running path cause the running rollers of the conveyable-article carriers to run unsteadily as they pass the transition between the first running-rail section and the diverter tongue, with the result that this partially balances out the advantage, achieved by the running-profile bridging element, of reducing the inflection between the first running-rail section and the diverter tongue in a relevant deflecting position of the diverter tongue.

The object of the invention is to improve a diverter of the generic type, as mentioned in the introduction, using straightforward means to the effect that it has less of an adverse effect on the smooth running of the conveyable-article carriers as they pass the transition between the first running-rail section and the diverter tongue.

In order to achieve this object, the invention proposes that in a transition region between the running profile of the first running-rail section and the bridging element—as seen in plan view—in each case one running-roller guide surface (running surface) of the first running-rail section and one running-roller guide surface (running surface) of the bridging element run one beside the other in the conveying direction for respectively supporting a running roller of a conveyable-article carrier, and/or that in a transition region between the bridging element and the running profile of the diverter tongue—as seen in plan view in each case one running-roller guide surface of the bridging element and one running-roller guide surface of the diverter tongue run one beside the other in the conveying direction for respectively supporting a running roller of a conveyable-article carrier.

The running-roller guide surfaces of the relevant elements of the first running-rail section and bridging element and also diverter tongue and bridging element interengage such that, for the running rollers of the conveyable-article carriers, they form a common path or track for a respective running roller at least in the non-pivoted position of the diverter tongue with sections running parallel to one another and one beside the other. If a conveyable-article carrier thus approaches the diverter tongue from the direction of the first running-rail section, then, in the transition region between the first running-rail section and bridging element, the running rollers of the conveyable-article carrier already come into contact with the respective running-roller guide surface of the bridging element while a laterally adjacent region of the running-roller circumference still remains supported on the running-roller guide surface of the first running-rail section. This avoids a transverse gap which forms a continuous interruption in the running-roller path, as has been explained above with reference to German Utility Model GM 19 16 359. In the non-pivoted position of the diverter tongue, the separating locations between the first running-rail section and bridging element and/or between the diverter tongue and bridging element form, for example, Z-gaps. It is not therefore necessary for the running rollers of a conveyable-article carrier to have their entire width rolling over a transverse gap. The present invention thus achieves the situation where it is possible to utilize the advantage of the running-profile bridging element in terms of reducing the inflection in the angled position of the diverter tongue, but separating locations of the running-roller paths are nevertheless configured such that they do not adversely affect the smooth running of the conveyable-article carriers to the same extent as in the case of generic diverters from the prior art.

Preferred developments of the invention are specified in the subclaims. It is thus proposed, for a suspended conveying apparatus for so-called V-trolleys, that the first running-rail section, the bridging element and the diverter tongue each have two running-roller guide surfaces which are arranged symmetrically in relation to a center plane of the relevant element and run obliquely in relation to one another in the conveying direction with the distance between them becoming smaller from bottom to top, it being the case that, at its connection end, the first running-rail section has a cutout which narrows the running-roller guide surfaces of the first running-rail section from the top, and the bridging element is received in said cutout by way of its end which is directed toward the first running-rail section, with the result that, in the transition region between the first running-rail section and bridging element, the running-roller guide surfaces of the bridging element are located above and laterally within the running-roller guide surfaces of the first running-rail section, it furthermore being the case that, at its end which is adjacent to the first running-rail section, the diverter tongue has a cutout which narrows the running-roller guide surfaces of the diverter tongue from the top, and wherein the bridging element is received in said cutout by way of its end which is directed toward the diverter tongue, with the result that, in the transition region between the bridging element and diverter tongue, the running-roller guide surfaces of the bridging element are located above and laterally within the running-roller guide surfaces of the diverter tongue.

In the non-pivoted position of the diverter tongue, the bridging element has its opposite ends resting on the first running-rail section and on the diverter tongue such that those sections of the running-roller guide surfaces which run one beside the other in the transition regions merge one into the other in something of a stepless manner.

Of course, the diverter according to the invention may be designed for connecting the first running-rail section optionally to further running-rail sections, with the result that the diverter can assume additional diverter positions.

It may also be provided that the running-profile bridging element is divided up into parts which are connected to one another in an articulated manner in order for the angle of inflection between the diverter tongue and first running-rail section, in an angled position of the diverter tongue relative to the first running-rail section, to be "subdivided" into a number of relatively small transition angles of the running-profile bridging element. The principle of the running-roller guide surfaces of adjacent parts interengaging in the conveying direction can also be realized for the bridging-element parts.

A sturdy construction of the diverter with automatically correct adjustment of the running-profile bridging element in each diverter position is achieved in a preferred embodiment of the invention in which the articulated arrangement has a main articulation via which the diverter tongue is connected to the first running-rail section at a location which is spaced apart vertically from the running-profile bridging element, and is in particular above the running-profile bridging element, such that it can be pivoted about a main pivot axis essentially parallel to the first and second pivot axes, the main pivot axis, in lateral projection, running between the first and the second pivot axes, in particular essentially centrally therebetween.

The main articulation preferably has a pivot pin on which the diverter tongue can be pivoted directly relative to the first running-rail section. Said pivot pin serves for guiding the pivoting movement of the diverter tongue, it being the case that, upon pivoting of the diverter tongue, the running-profile bridging element passes automatically into its position in which the angle of inflection between the first running-rail section and the diverter tongue is "subdivided".

According to a preferred configuration, the diverter is designed for integration in a suspended conveying apparatus in which the conveyable-article carriers are supported on the running profiles of the relevant running rails in a suspended manner by way of their running rollers. The diverter has a carrier plate, on the underside of which the running-rail sections are fastened, and the diverter tongue is retained such that it can be pivoted about the main pivot axis, and an actuating mechanism for the diverter tongue is arranged on the top side thereof, wherein the actuating mechanism has a carry-along pin which can be moved between two positions corresponding to the diverter positions, is intended for the diverter tongue, extends downward through the opening of the carrier plate and, at its bottom end, is connected to the diverter tongue such that, as it moves, it can pivot the diverter tongue about the main pivot axis.

In this case, the main articulation preferably has a pivot pin which is intended for the diverter tongue, is mounted in a retaining-web section of the first running-rail section, said retaining-web section being located above the running-profile bridging element, and in an opening of the carrier plate, and passes through a retaining-web section of the diverter tongue, said retaining-web section overlapping with the retaining-web section of the first running-rail section. This makes it possible to realize a diverter construction which can be subjected to loading and has stable mounting for the diverter tongue. On at least two mutually opposite side borders, the carrier plate preferably has upwardly projecting side walls which form, with the carrier plate, a box-like housing for the actuating mechanism. Said box-like housing has an overall stabilizing action as far as the diverter is concerned and conceals the actuating-mechanism elements arranged on the top side of the carrier plate, which is beneficial for the design of the diverter.

According to a development of the invention, the actuating mechanism has a changeover plate which is mounted on the top side of the carrier plate such that it can be pivoted between two positions corresponding to the diverter positions and on which the carry-along pin for the diverter tongue is fastened. Furthermore, it is also possible for the pivot drive for the change-over plate to be accommodated in the box-like housing, which is formed by the carrier plate and the side walls. The pivot drive may be, for example, a pneumatic piston/cylinder subassembly.

The side walls projecting upward from the carrier plate are preferably provided with fastening means for fastening the diverter within the conveying apparatus.

An exemplary embodiment of the invention is explained in more detail hereinbelow with reference to the figures, in which.

Figure 1:
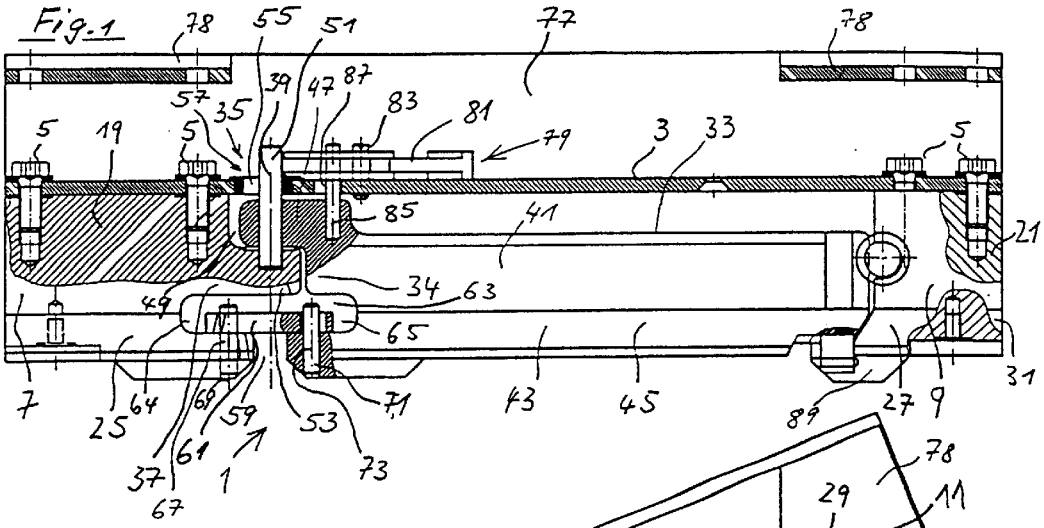
FIG. 1 shows a partially sectional side view of a diverter according to the invention.

The preferred exemplary embodiment illustrated is a diverter unit 1 for a suspended conveying apparatus, with running rails arranged in a suspended manner, in which conveyable-article carriers (V-trolleys) provided with running-roller pairs are supported on running surfaces of the running rails in a suspended manner and can be moved along the running rails.

The diverter unit 1 illustrated in the figures has three running-rail sections 7, 9, 11 which are fastened on a carrier plate 3 in a suspended manner by means of fastening screws 5 and, at their outwardly oriented ends, are to be connected to correspondingly assigned ends of running rails of the conveying apparatus. The running-rail sections 7, 9, 11 each have a vertical, top retaining web 19, 21, 23, into which the fastening screws 5, which pass through the carrier plate from above, are screwed, and a respective running profile 25, 27, 29 at the bottom end of the relevant retaining web 19, 21, 23. The running profiles each have two running-roller guide surfaces 31, or running surfaces 31, for the running-roller pairs of the conveyable-article carriers, said surfaces 31 being arranged symmetrically in relation to the vertical longitudinal center plane of the running rails. The running surfaces 31 run obliquely in relation to the vertical longitudinal center plane of the relevant running-rail section 7, 9 or 11, with the result that their bottom borders are spaced apart from one another by a greater distance than their top borders. In this respect, the running-rail sections 7, 9, 11 correspond to the adjoining running rails of the suspended conveying apparatus.

Figure 2:
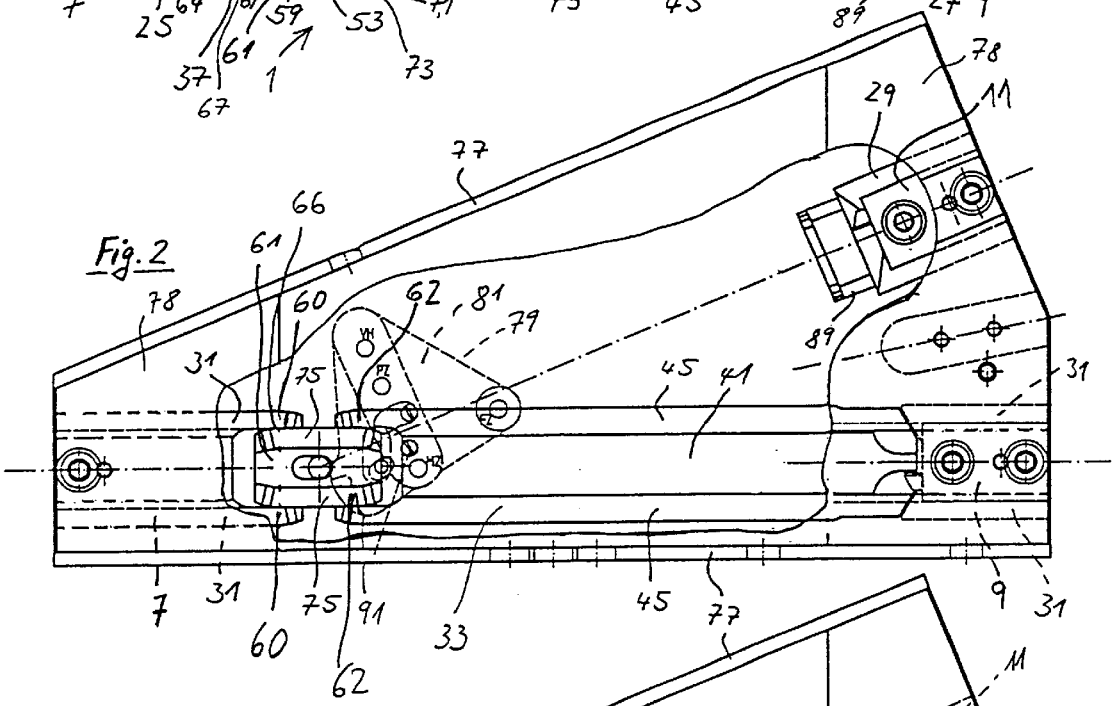
FIG. 2 shows, in a broken-away illustration, the diverter according to FIG. 1 in plan view, the diverter tongue being in a first diverter position.
Figure 3:
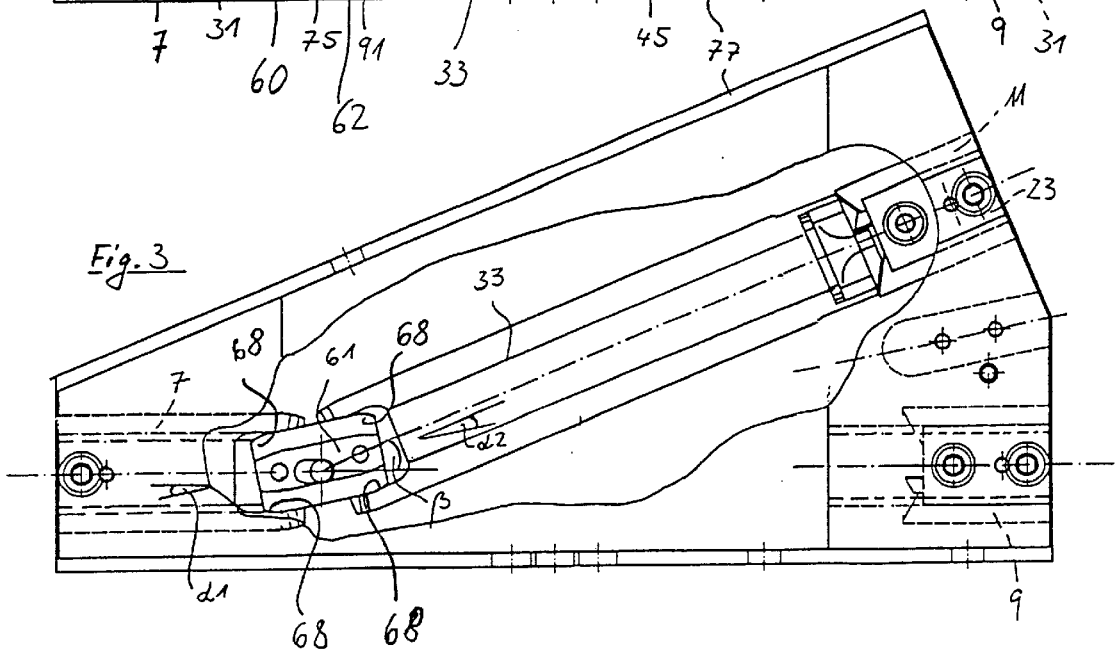
FIG. 3 shows the diverter according to FIGS. 1 and 2 in a view corresponding to FIG. 2, the diverter tongue being in a second diverter position.

The diverter 1 serves for connecting the first running-rail section 7 optionally to the second running-rail section 9 or to the third running-rail section 11 for the continued advancement of conveyable-article carriers. For this purpose, a diverter tongue 33, at its end 34, is connected to the inner connection end 37 of the first running-rail section 7 via an articulated arrangement 35 so as to be pivotable about a main pivot axis 39 such that it can be pivoted between the first diverter position, which is shown in FIG. 2, with connection to the second running-rail section 9 and the second diverter position, which is shown in FIG. 3, with connection to the third running-rail section 11. The diverter tongue 33, which runs rectilinearly in the case of the example, has a retaining web 41 and, at the bottom end thereof, a running profile 43 with oblique running surfaces 45 for the running-roller pairs of the conveyable-article carriers. At its end 34, the diverter tongue 33 has, on the retaining web 41, a nose 47 which engages in a recess 49 of the retaining web 19 of the first running-rail section 7. The nose 47 has the pivot pin 51 passing through it, said pivot pin being mounted, at its bottom end, in the section 53 of the retaining web 19 of the first running-rail section, said section 53 projecting toward the diverter tongue, and having its top end projecting upward through an opening 55 of the carrier plate 3. The pivot pin 51 forms, with its bearing and the overlapping noses 47, 53, a main articulation 57 for the pivoting movement of the diverter tongue 33 relative to the first running-rail section 7.

In the region of the running profiles 25 and 43, the mutually opposite ends of the first running-rail section 7 and the diverter tongue 33 are spaced apart at 59 by a distance which is bridged by a running-profile bridging element 61. The running-profile bridging element 61 is located, in the cutout region 63, in depressions 64, 65 on the running profiles 25 and 43 and is articulated both on the first running-rail section 7 and on the diverter tongue 33 such that it can be pivoted via the pivot pins 67 and 71, the associated pivot axes 69 and 73 and the main pivot axis 39 running essentially parallel to one another in the positions of the diverter 1 which are shown. Moreover, in the first diverter position, which is shown in FIGS. 1 and 2, the main pivot axis 39 runs essentially centrally between the two pivot axes 69 and 73.

The running-profile bridging element 61 likewise has correspondingly oblique running surfaces 75 for the roller pairs of conveyable-article carriers. As can be seen in FIG. 2, there is a transition region 60 between the first running-rail section 7 and the bridging element 61. In this transition region 60, there is a path section, for the running rollers of the conveyable-article carriers, in which the running surfaces 31 of the first running-rail section 7 run—in plan view—in each case outside alongside the running surfaces 75 of the bridging element 61 and—in side view—beneath the running surfaces 75 of the bridging element 61 such that, in the non-pivoted position of the diverter tongue 33, the two running surfaces 31, 75 can form the track or path for a respective running roller of a conveyable-article carrier in the transition region 60. If a conveyable-article carrier thus, according to FIG. 2, approaches the diverter tongue 33 from the direction of the first running-rail section 7, then the running rollers, which are initially supported merely on the running surfaces 31, pass into the transition region 60, where they are temporarily supported by the running surfaces 31, 75 of the elements 7 and 61 at the same time. Thereafter, the bridging element 61 assumes the task of guiding the running rollers until the conveyable-article carrier passes, by way of its running rollers, into the transition region 62 between the bridging element 61 and the diverter tongue 33. In this transition region 62, the running rollers are guided by the running surfaces 31, 45 of the two elements 61, 33 until, after they have left the transition region 62, they are supported on the running surfaces 45 of the diverter tongue 33. This means that, in the transition regions 60 and 62, there are no transverse gaps, which separated the track or path of the running rollers continuously transversely to the conveying direction, between the first running-rail section 7 and bridging element 61 and between the bridging element 61 and diverter tongue 33. In the diverter according to the invention, the transition gap indicated at 66 has a component in the conveying direction. This has the advantage that, when traveling straight ahead in accordance with the diverter position according to FIG. 2, the running rollers do not at any time have to overcome a transverse gap on their path 31, 75, 45 by way of their entire running-roller width. This means that, despite the use of the additional bridging element 61, there is no adverse effect on the smooth running of the running rollers in the transition region 60 or 62.

It should also be pointed out that the bridging element 61, in the plan view according to FIGS. 2 and 3, has a slightly rounded contour in the corner regions at 68. The rounded formations are preferably selected such that, even in the angled position of the diverter tongue 33 according to FIG. 3, uniform, smooth-running passage of the conveyable-article carriers through the transition region 60, 62 can take place.

The interposition of the running-profile bridging element 61 achieves the situation, in the case of the diverter tongue 33 being angled relative to the first running-rail section 7 (see FIG. 3), where the transition between the first running-rail section 7 and the diverter tongue 33 for the running-roller pairs of the conveyable-article carriers is smoother than in the case of diverters from the prior art, in which the running profiles of the first running-rail section and of the diverter tongue are articulated directly on one another via a single pivot pin. In the case of the diverter 1 according to the invention, the running rollers of a conveyable-article carrier coming from the first running-rail section 7 first of all are deflected by the angle al during transition to the running-profile bridging element 61 and then, finally, undergo further deflection about the angle $\alpha 2$ when they transfer from the running-profile bridging element 61 to the diverter tongue 33. In the case of the example, the angles $\alpha 1$ and $\alpha 2$ are essentially equal and only half the magnitude of the angle $\beta$, which the diverter tongue 33 assumes relative to the first running-rail section 7 in the second diverter position according to FIG. 3. On account of the gentler deflection about the angles $\alpha 1$ and $\alpha 2$ brought about by the running-profile bridging element 61, the diverter 1 according to the invention achieves smoother and more uniform rolling behavior of the conveyable-article carriers as they pass the diverter. This is accompanied by lower wear to the running rollers of the conveyable-article carriers and by the running-roller bearings, usually designed as ballbearings, being subjected to lower impact loading. Furthermore, the gentler deflection is accompanied by the conveyable-article carriers producing a lower level of running noise. Since the levels of discontinuity in the running path at the transition between the first running-rail section 7 and the diverter tongue 33 are comparatively low, it is also the case that the parts of the diverter are subjected to less wear and tear on account of being subjected to less impact loading by conveyable-article carriers.

In the diverter unit illustrated in FIGS. 1–3, the diverter tongue 33 connects optionally the two running-rail sections 9 and 11 to the first running-rail section 7. According to a variant, it would also be possible to provide further running-rail sections, in the direction of which the diverter tongue 33 could be pivoted, in which case the running-profile bridging element 61 performs the abovedescribed function of reducing the respective inflection between the first running-rail section 7 and the diverter tongue 33.

According to a further variant, it would be possible for the running-profile bridging element 61 to be subdivided into two or more links connected in an articulated manner to one another, with the result that, although further deflecting positions of the running path are formed in the transition region between the first running-rail section 7 and the diverter tongue 33, each of these deflecting locations has a comparatively small deflecting angle, and the angle of inflection $\beta$ between the first running-rail section 7 and the diverter tongue 33 is thus further reduced by further "subdivision". If one takes this idea of the increasing subdivision of the running-profile bridging element 61 further, then, in the extreme case, a continuously flexible running-profile bridging element is conceivable within the context of the present invention, said continuously flexible bridging element providing a continuous transition between the first running-rail section 7 and the diverter tongue 33 in each diverter position.

Coming back to the exemplary embodiment shown in the figures, it should be pointed out that, on its longitudinal borders, the carrier plate has vertically upwardly projecting walls 77 which form, together with the carrier plate 3, a box-like housing for the actuating mechanism 79, arranged on the carrier plate 3, for the diverter tongue 33, said housing ensuring high stability for the diverter. In addition, the side walls 77 are connected to one another by cover sections at their top ends at 78, 78. The actuating mechanism 79 comprises a changeover plate 81 which is mounted on a pivot pin 83 on the carrier plate 3 such that it can be pivoted between two pivot positions and which has a carry-along pin 85 which extends through a slot 87, provided in the carrier plate 3, and engages in a bore of the diverter-tongue nose 47 at a horizontal distance from the main pivot axis 39 of the diverter tongue 33. During pivoting of the changeover plate 81 about the pivot pin 83, the carry-along pin 85 is moved in the slot 87, in which case it carries along the diverter tongue 33 to produce a corresponding pivoting movement about the main pivot axis 39. The end positions of the carry-along pin 85 which can be achieved during pivoting of the changeover plate 81 correspond to the two diverter positions of the diverter tongue 33. As pivot drive for the changeover plate 81, it is possible to provide, for example, a pneumatic piston/cylinder unit (not shown). It should also be pointed out that the second running-rail section 9 and the third running-rail section 11 each have a bearing plate 89 for that end of the diverter tongue 33 which is remote from the articulated arrangement 35, it being the case that, in the respective diverter position, the diverter tongue 33 grips over the relevant bearing plate 89 partially from above. It should further be pointed out that the running profiles 27 and 29 of the running-rail sections 9 and 11, respectively, are beveled at their inwardly oriented ends, and the diverter tongue 33 has a complementary beveled formation at its free end.

In order that the diverter tongue. 33 can be freed from the bearing plate 89 during changeover between the diverter positions according to FIGS. 2 and 3, the articulated arrangement 35 is defined such that it allows tilting of the diverter tongue 33 in vertical tilting planes. For this purpose, the pivot pin 51 can be tilted in the counterclockwise direction relative to the first running-rail section 7, out of the vertical position shown in FIG. 1, by an amount which is limited by the play of the slot 55 in the carrier plate 3, the free end of the diverter tongue 33 lifting off from the relevant bearing plate 89 of the second running-rail section 9 or of the third running-rail section 11. Upon reaching the accordingly activated diverter position, the main pivot pin 51 is then tilted back again into its vertical position, in order to position the diverter tongue 33 on the relevant bearing plate 89. For the purpose of controlling the tilting movement of the main pivot pin 51 and of the diverter tongue 33 arranged thereon, the changeover plate 81 of the actuating mechanism 79 has, on its border, a cam (at 91 in the changeover plate 81, of which the contours are indicated in FIG. 2) which is in engagement with the top end of the main pivot pin 51. As the changeover plate 81 is pivoted out of the respective end position corresponding to a diverter position, the cam 91 forces the main pivot pin 51 first of all into the tilting position, in order for the free end of the diverter tongue 33 to be lifted off from the relevant bearing plate 89. As soon as the changeover plate 81 then reaches its other end position, the cam 91 frees the pivot pin 51 again so that it can tilt back into the vertical position. This operation of tilting back into the vertical position takes place automatically on account of the torque caused by the weight of the diverter tongue 33. In this case, the diverter tongue 33 comes into engagement with the relevant bearing plate 89 of the connected running-rail section 9 or 11.

The bearings of the pivot pins 67 and 71 and of the carry-along pin 85 are of such a nature that they allow the tilting movement of the diverter tongue 33 explained above.

The diverter unit according to the invention may be produced, for example, essentially of metal, preferably aluminum, or plastic.

It has an overall stable construction, and makes it possible for relatively large loads to be received on corresponding conveyable-article carriers, although the conveyable-article carriers can pass the diverter relatively uniformly and without any significant impact loading.

What is claimed is:

1. A diverter for a suspended conveying apparatus, in which conveyable-article carriers provided with running rollers are guided such that they can be moved on running profiles of running rails, the diverter comprising a diverter tongue configured as a movable running rail and, at one end is connected to a connection end of a first running-rail section via an articulated arrangement so as to be pivotable between two diverter positions such that an end of the diverter tongue remote from the articulated arrangement connectable to either one of a free end of a second running-rail section or to a free end of a third running-rail section, wherein the articulated arrangement has a running-profile bridging element that connects a running profile of the first running-rail section at the connection end thereof to a running profile of the diverter tongue at the one end thereof, which is adjacent to the first running-rail section, the bridging element being mounted to be pivotable about a first pivot axis at the connection end of the first running-rail section and pivotable about a second pivot axis, which is substantially parallel to the first pivot axis at the adjacent end of the diverter tongue, wherein in a transition region between the running profile of the first running-rail section and the bridging element as seen in plan view in each case one running-roller guide surface of the first running-rail section and one running-roller guide surface of the bridging element run one beside the other in a conveying direction for respectively supporting a running roller of a conveyable-article carrier, and/or wherein in a transition region between the bridging element and the running profile of the diverter tongue as seen in plan view in each case a running-roller guide surface of the bridging element and a running-roller guide surface of the diverter tongue run beside each other in the conveying direction, respectively, to support a running roller of a conveyable-article carrier, wherein the first running-rail section, the bridging element and the diverter tongue each have two running-roller guide surfaces which are arranged symmetrically in relation to a center plane of the relevant element and run obliquely in relation to one another in the conveying direction with the distance between them becoming smaller from bottom to top, wherein, at its connection end, the first running-rail section has a cutout which narrows the running-roller guide surfaces of the first running-rail section from the top, and wherein the bridging element is received in said cutout by way of its end which is directed toward the first running-rail section, with the result that, in the transition region between the first running-rail section and bridging element, the running-roller guide surfaces of the bridging element are located in side view above and in plan view laterally within the running-roller guide surfaces of the first running-rail section, wherein furthermore, at the end adjacent to the first running-rail section, the diverter tongue has a cutout which narrows the running-roller guide surfaces of the diverter tongue from the top, and wherein the bridging element is received in the cutout by way of the end which is directed toward the diverter tongue, with the result that, in the transition region between the bridging element and diverter tongue, the running-roller guide surfaces of the bridging element are located in side view above and in plan view laterally within the running-roller guide surfaces of the diverter tongue.

2. The diverter as claimed in claim 1, wherein the articulated arrangement has a main articulation via which the diverter tongue is connected to the first running-rail section at a location which is spaced apart vertically from the running-profile bridging element, and is in particular above the running-profile bridging element, such that it can be pivoted about a main pivot axis essentially parallel to the first and second pivot axes, the main pivot axis, in lateral projection, running between the first and the second pivot axes, in particular essentially centrally therebetween.

3. The diverter as claimed in claim 2 for a suspended conveying apparatus in which the conveyable article carriers are supported on the running profiles of the relevant running rails in a suspended manner by way of their running rollers, wherein the diverter has a carrier plate, on the underside of which the running-rail sections are fastened, and the diverter tongue is retained to be pivotable about the main pivot axis, and an actuating mechanism for the diverter tongue is arranged on the top side thereof, wherein the actuating mechanism as a carry-along pin which can be moved between two positions corresponding to the diverter positions, is intended for the diverter tongue, extends downward through an opening of the carrier plate and, at its bottom end, is connected to the diverter tongue such that, as it moves, it can pivot the diverter tongue about the main pivot axis.

4. The diverter as claimed in claim 3, wherein the main articulation has a pivot pin which is intended for the diverter tongue, is mounted in a retaining-web section of the first running-rail section, the retaining-web section being located above the running-profile bridging element, and in an opening of the carrier plate, and passes through a retaining web section of the diverter tongue, said retaining-web section overlapping with the retaining-web section of the first running rail section.

5. The diverter as claimed in claim 3, wherein the actuating mechanism has a changeover plate which is mounted on the top side of the carrier plate such that it can be pivoted between two positions corresponding to the diverter positions and on which the carry-along pin for the diverter tongue is fastened.

6. The diverter as claimed in claim 5, wherein the actuating mechanism has, on the top side of the carrier plate, a pivot drive which is designed, in particular, as a pneumatic piston/cylinder subassembly and is intended for the changeover plate.

7. The diverter as claimed in claim 3, wherein, on at least two mutually opposite side borders, the carrier plate has upwardly projecting side walls which form, with the carrier plate, a box-like housing for the actuating mechanism.

8. The diverter as claimed in claim 7 wherein the side walls have fastening means for fixing the diverter within a conveying apparatus.

9. The diverter as claimed in claim 7, wherein the box-like housing has a cover plate.

* * * * *